US007736483B2

(12) United States Patent
Huang et al.

(10) Patent No.: US 7,736,483 B2
(45) Date of Patent: Jun. 15, 2010

(54) METHOD FOR ELECTROPLATING METAL WIRE

(75) Inventors: Chun-Yau Huang, Hsinchu (TW); Cheng-Chung Chen, Ilan (TW); Yong-Fu Wu, Taipei (TW); Cheng-Hung Tsai, Changhua (TW); Chwan-Gwo Chyau, Taipei (TW); Fang-Tsun Chu, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 733 days.

(21) Appl. No.: 11/625,269

(22) Filed: Jan. 19, 2007

(65) Prior Publication Data

US 2007/0131557 A1 Jun. 14, 2007

Related U.S. Application Data

(62) Division of application No. 10/636,533, filed on Aug. 8, 2003, now abandoned.

(30) Foreign Application Priority Data

Jan. 4, 2003 (TW) ..... 92107433 A

(51) Int. Cl.
*C25D 5/02* (2006.01)
*H01L 21/00* (2006.01)

(52) U.S. Cl. ..... 205/123; 438/480; 438/510

(58) Field of Classification Search ..... 205/118, 205/123, 157, 159, 183; 438/480, 510, 584
See application file for complete search history.

(56) References Cited

U.S. PATENT DOCUMENTS 6,858,479 B2 * 2/2005 Kim et al. ..... 438/158

* cited by examiner

*Primary Examiner*—Luan V Van
(74) *Attorney, Agent, or Firm*—Quintero Law Office

(57) ABSTRACT

A method for electroplating low-resistance metal wire for resolving the problem to fabricate the metal wire on large-area substrate through the technology of photolithographing and etching in the prior art. Then the invention improves the RC-delay characteristic of circuit on large-area substrate and reduces the number of masks for processing of a structure of gate overlap lightly-doped drain (source) (GOLDD).

8 Claims, 7 Drawing Sheets

METHOD FOR ELECTROPLATING METAL WIRE

CROSS REFERENCE TO RELATED APPLICATIONS

This application is a Divisional of U.S. application Ser. No. 10/636,533, filed Aug. 8, 2003, the entire disclosure of which is hereby incorporated by reference.

BACKGROUND OF THE INVENTION

1. Field of the Invention

The present invention generally relates to a method for electroplating metal wire, especially for electroplating low-resistance metal wire on large-area substrate and reducing the number of photolithography masks for processing thin-film transistors (TFTs) with a structure of gate overlap lightly-doped drain (source) (GOLDD).

2. Description of the Related Art

With the advance of processing technology, the large-area TFT (Thin Film Transistor) displays will be generalized. Then some problems are going to be revealed in producing, generally the wiring on substrate is getting complicate, then the RC-delay caused by the increasing wire resistance (R) and related capacitance (C) will impact the efficiency factors of device, like the cross talk and power consuming, especially the signal transmission speed. As the featuresize of semiconducting technology becomes smaller, it is more difficult to prevent the RC-delay, which occurs as the width of wire and distance between wires are getting smaller, then there will increase the serial resistance and the capacitance among those connecting.

Copper (Cu) and silver (Ag) have the lowest resistance among metals, which provide the simplest and directly way to reduce the connecting resistance and capacitance, but they couldn't be fabricated on glass substrate through prior photolithographing and etching technology.

Further, for fabricating the copper wire on large-area substrate, the prior art method adopts a complicate and expensive chemical mechanical polishing/planarization (CMP) process, which is a planarization technology in semi-conducting processing. The planarization is used to planarize the roughness on doping layer of semiconductor device by the cooperation of chemical etching and mechanic polishing processes.

Therefore, there needs to provide a method for electroplating metal wire to improve the RC-delay characteristics among the wires on glass substrate and the method for electroplating low-resistance metal on it. The structure of gate overlap and lightly-doping drain (source) of present invention can reduce the number of processing masks.

BRIEF SUMMARY OF THE INVENTION

It is a primary object of the present invention to provide a method for electroplating low-resistance metal wire for resolving the problem to fabricate the metal wire on large-area substrate through the technology of photolithographing and etching in the prior art. Then the invention improves the RC-delay of circuit on large-area substrate and reduces the number of masks on processing of the thin film transistor with structure of gate overlap and lightly-doping drain (source) (GOLDD).

Method for electroplating comprising steps of: depositing an isolated layer above said substrate; depositing a first metal seed layer on said oxide layer; electroplating a first metal layer on said first metal seed layer, which has already been patterned; depositing an inter-layer; depositing a second metal seed layer; and electroplating a second metal layer on said second metal seed layer.

In addition, TFTs with gate overlapped lightly doped drain (GOLDD) structure has been shown to be effective in reducing the drain field in both on and off states of the TFT, without introducing appreciable series resistance effects. Therefore, TFTs with GOLDD structure can provide good device electrical characteristics. The present invention can reduce the number of photolithography masks for processing TFTs with GOLDD structure when adopting the electroplating metal wire process.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The present invention to provide a method for electroplating low-resistance metal wire for resolving the problem to fabricate the metal wire on large-area substrate, then the invention improves the RC-delay of circuit on that substrate and reduce the number of masks on processing by the structure of gate overlap and lightly-doping drain (source).

Figure 1A:
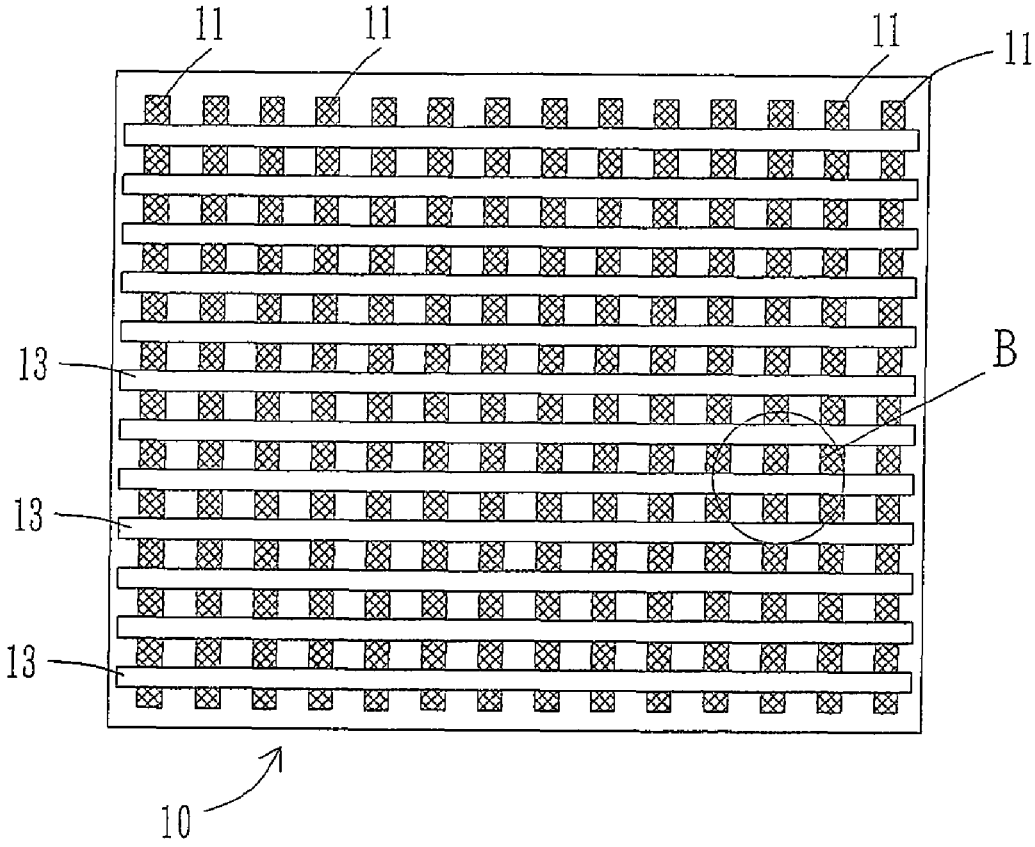
FIG. 1A(PRIOR ART)
FIG. 1A is a schematic diagram showing wiring on TFT display in the current technology.
Figure 1B:
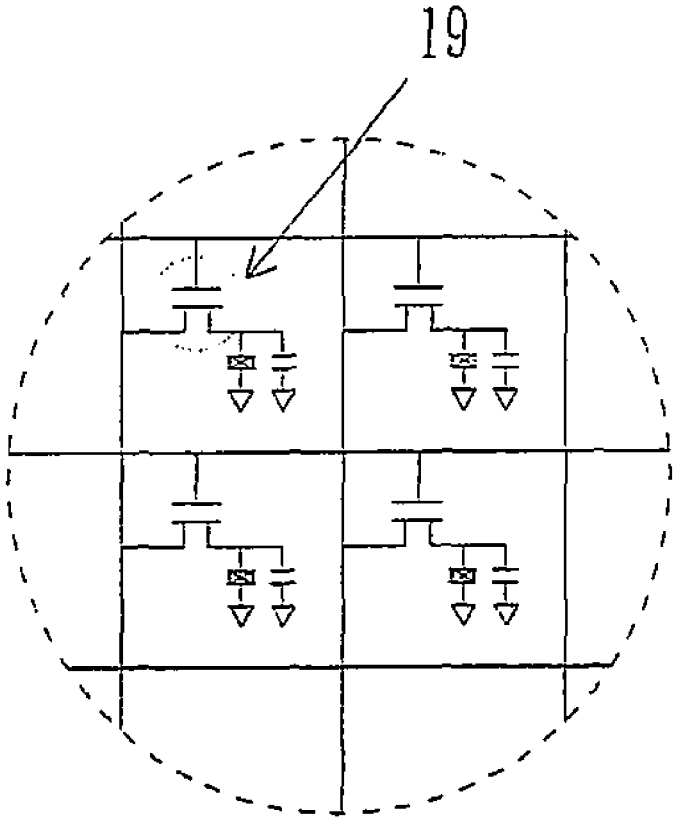
FIG. 1B (PRIOR ART)
FIG. 1B is a portion detail schematic diagram according to FIG. 1A.

Please refer to FIG. 1A, which is a schematic diagram showing wiring on TFT (Thin Film Transistor) display in the current technology. FIG. 1B is a portion detail schematic diagram showing the TFT device 19 according to FIG. 1A. There is a panel 10 including a plurality of date lines 11 from source end, and a plurality of scan lines 13 from gate end of panel 10. As shown in a partially enlarged part of this diagram, the data lines 11 and scan lines 13 are vertical with each other, and the cross regions enclosed by the plurality of data lines 11 and scan lines 13 are the TFT devices 19 (shown in FIG. 1B) and pixel electrodes on the panel 10. These data lines 11 and scan lines 13 are comprised by metal material In the present invention, those lines are formed by electroplating in an electroplating solution involving the ions of that metal.

The invention is used to improve the effect of RC-delay of circuit through the method for electroplating the low-resistance metal on substrate.

Figure 1C:
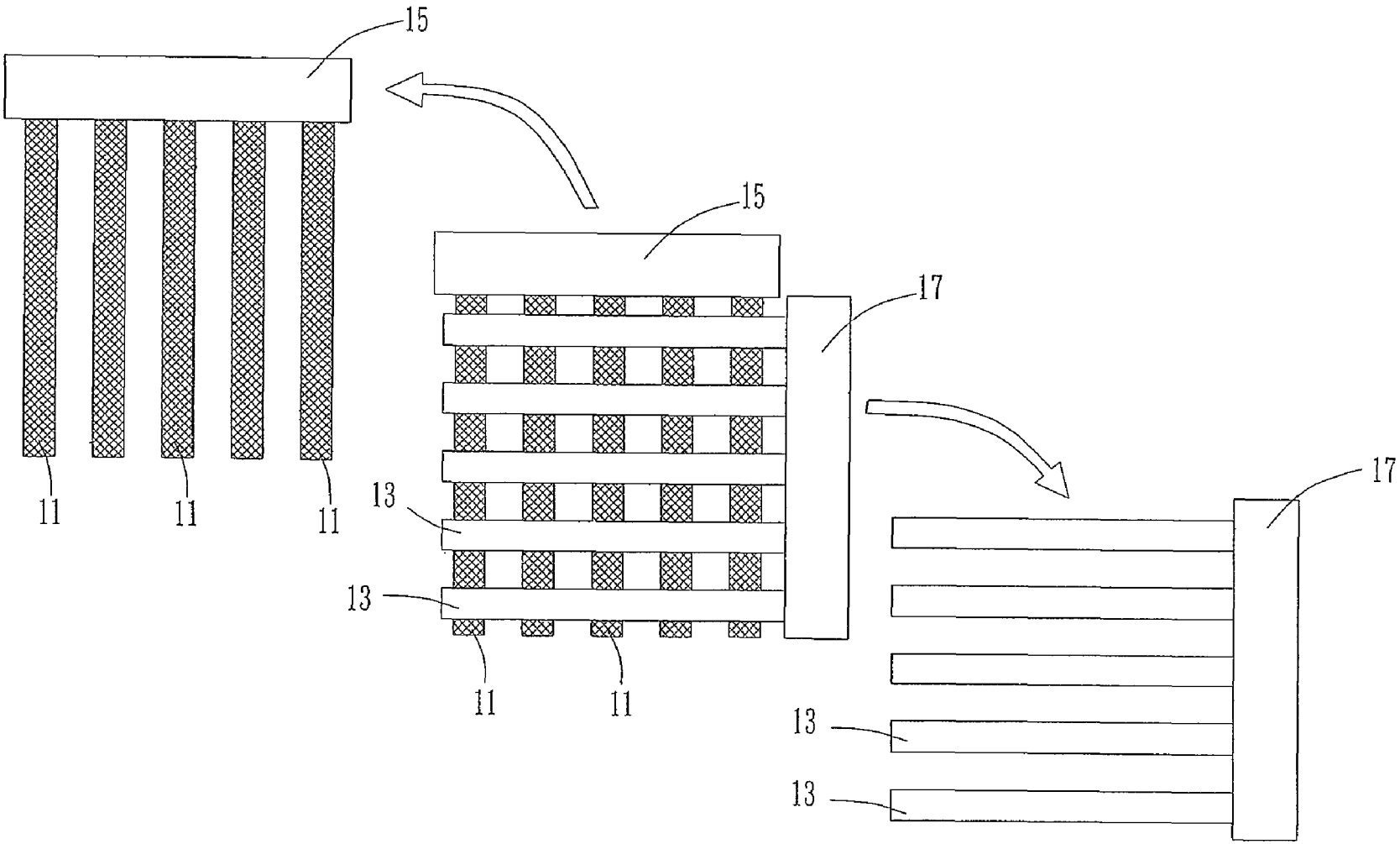
FIG. 1C (PRIOR ART)
FIG. 1C is a schematic diagram showing wire-electroplating on TFT display in the current technology.

In FIG. 1C, which is a schematic diagram showing wire-electroplating on TFT display in the current technology. A first electrode plate 15 is used to short-circuit the plurality of data lines 11, that means the first electrode plate 15 which is a conductor, connected with the ends of these data lines 11. The first electrode plate 15 and the data lines 11 are immersed into an electroplating solution for electroplating. The electroplating solution includes the ions of low-resistance metal which is electroplated on those data lines 11. A second electrode plate 17 is used to short-circuit the plurality of scan lines 13 and immersed into the electroplating solution including the ions of low-resistance metal. Then, the scan lines 13 are electroplated by conducting the second electrode plate 17.

Figure 2A:
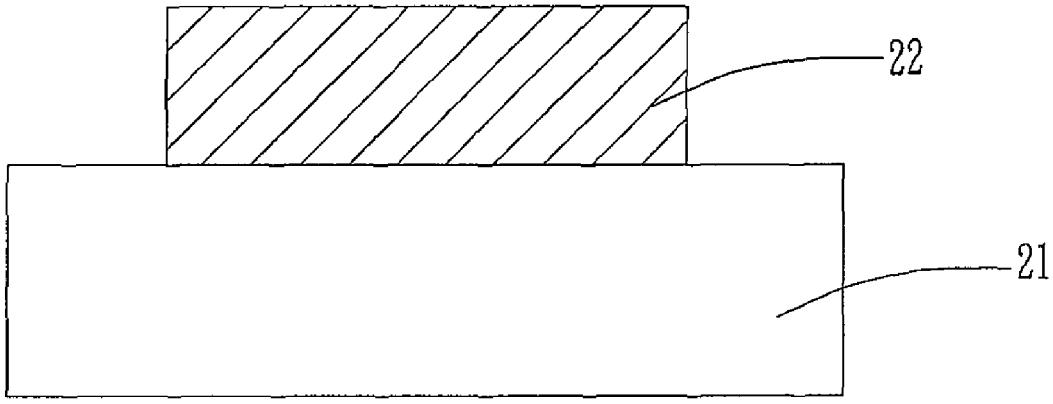
FIG. 2A to FIG. 2B are schematic diagrams showing the process for electroplating in accordance with one preferred embodiment of the present invention.
Figure 2B:
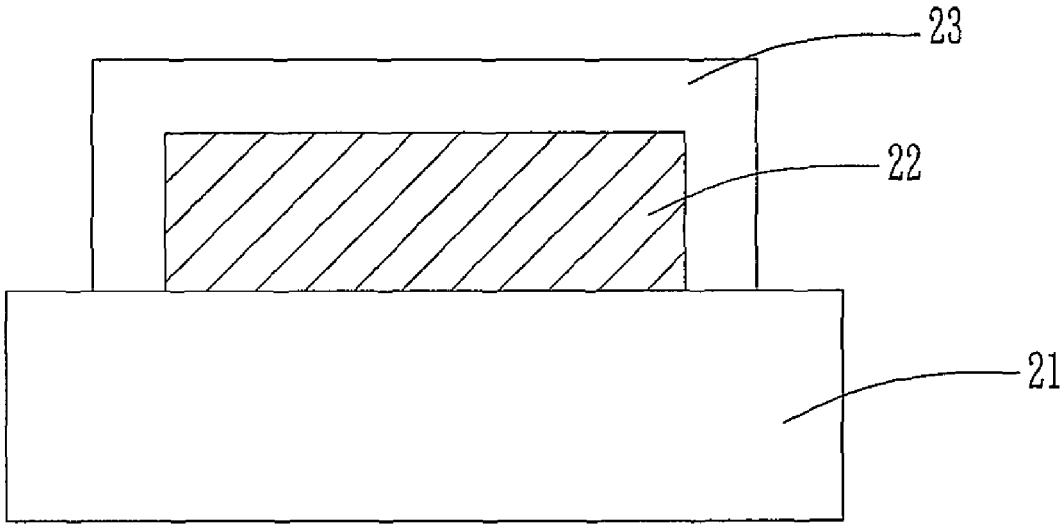

The FIG. 2A and FIG. 2B are schematic diagrams showing the process for electroplating on substrate 21, which can be glass, plastic, quartz or silicon substrate, and is not limited to those disclosed in the present invention. In FIG. 2A is showing the step of depositing a metal seed layer 22 above a substrate 21, the metal seed layer 22 is the seed used for attracting the ions in electroplating solution in this method. In the next step showed in FIG. 2B, there is a metal layer 23 electroplated above the metal seed layer 22. The pattern and thickness of the metal layer 23 are defined by patterning the metal seed layer 22 and the time to electroplate, longer time to electroplate will induce a thicker metal layer 23.

Figure 3A:
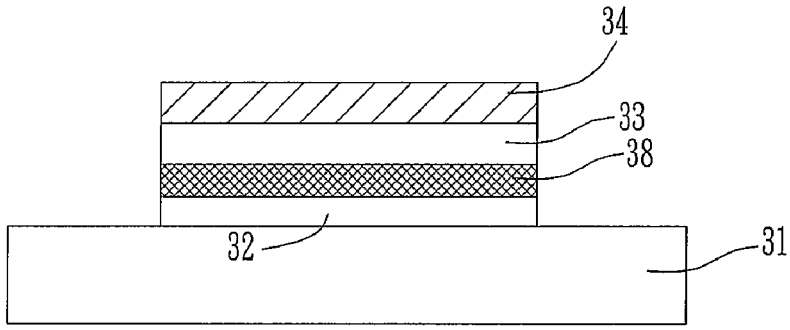
FIG. 3A to FIG. 3E are schematic diagrams showing the process for electroplating and the structure in accordance with one preferred embodiment of the present art.

FIG. 3A to FIG. 3E are schematic diagrams showing the process for electroplating and the device structure in accordance with one preferred embodiment of the present art. In FIG. 3A, a substrate 31 is prepare and then an isolated layer 32 is coated thereon and used to isolate the components, which will be formed on the substrate 31. Afterward a silicon thin film layer 38 is deposited above the isolated layer 32, and the silicon thin film layer 38 can be the active layer of this device. Next, an oxide layer 33 is deposited above the silicon thin film layer 38. Then a metal seed layer 34 is deposited on the oxide layer 33, this metal seed layer 34 also has a required pattern through the processes of patterning and etching.

Figure 3B:
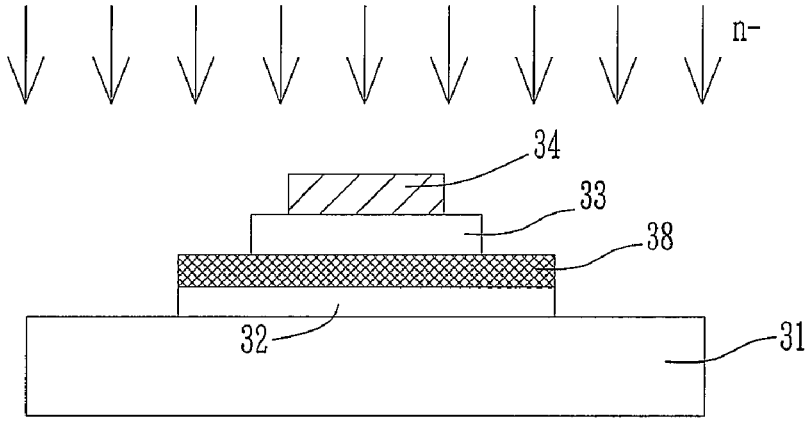

In FIG. 3B shows that the oxide layer 33 and metal seed layer 34 have been patterned and etched. At meantime, impurities such as B and P are ion-implanted in to the device with light dose, thus forming lightly doped p-type region and lightly doped n-type region, respectively in the device.

Figure 3C:
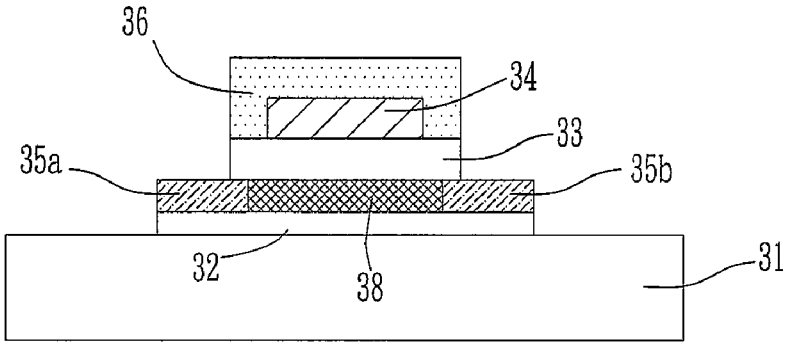

As in FIG. 3C, after lightly-doped drain 35*a* and lightly-doped source 35*b* are formed on both sides of the silicon thin film layer 38 by ion-implantation, a metal layer 36 is electroplated to cover the metal seed layer 34. More particularly, the device to be subjected to the electroplating process is immersed into an electro bath including the ions of the metal for the metal layer 36. In the present invention, the metal layer 36 employs low-resistance metal material such as Cu and Ag.

Figure 3D:
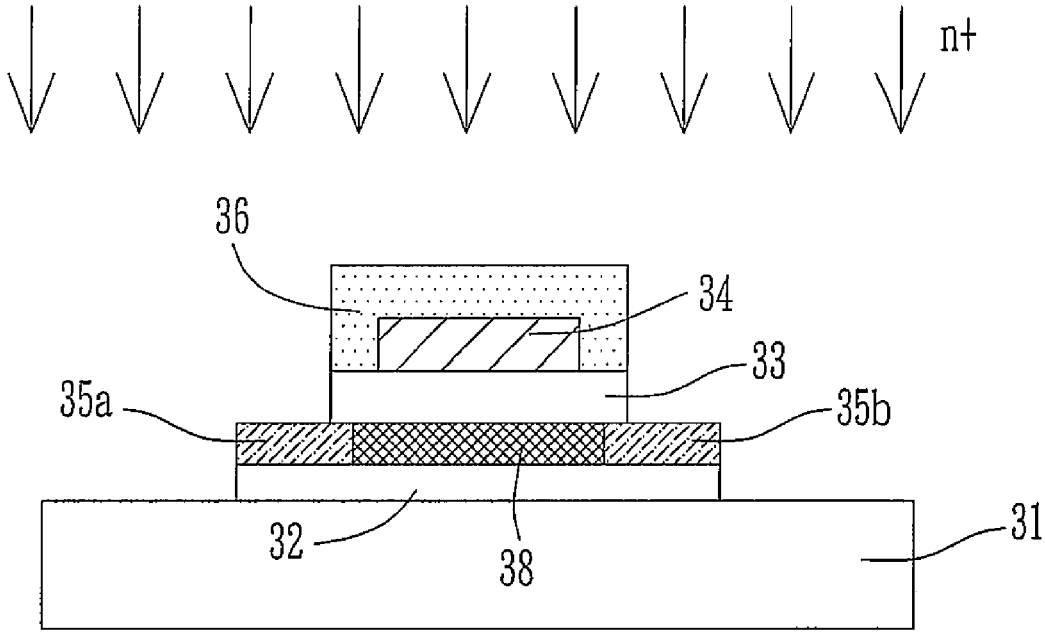
Figure 3E:
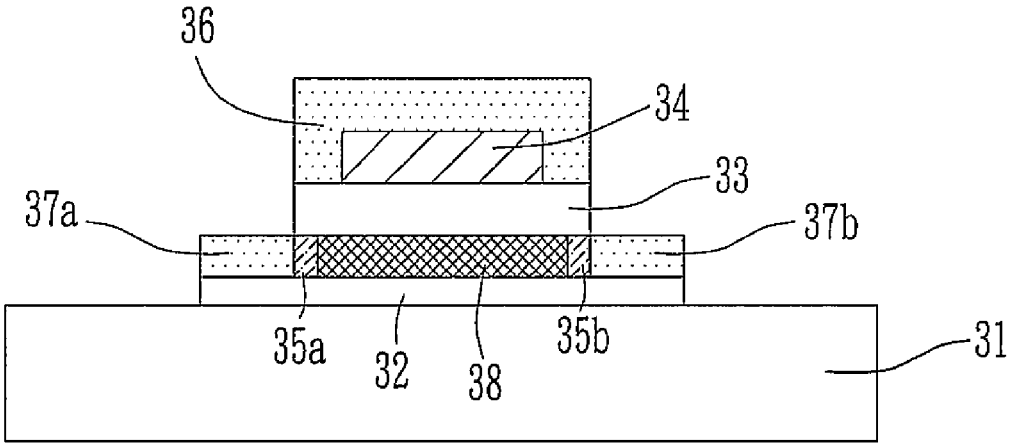

FIG. 3D is the step of doping highly-dose impurity ions of by ion-implantation. Then, as in FIG. 3E, a drain 37*a* and a source 37*b* are respectively formed on lateral sides of the lightly-doped drain 35*a* and the lightly-doped source 35*b* by ion implanting highly-dose ions of impurity. The structure of gate overlap lightly-doped drain (source) shown in those figures can advantageously reduce mask number for manufacture.

Figure 4:
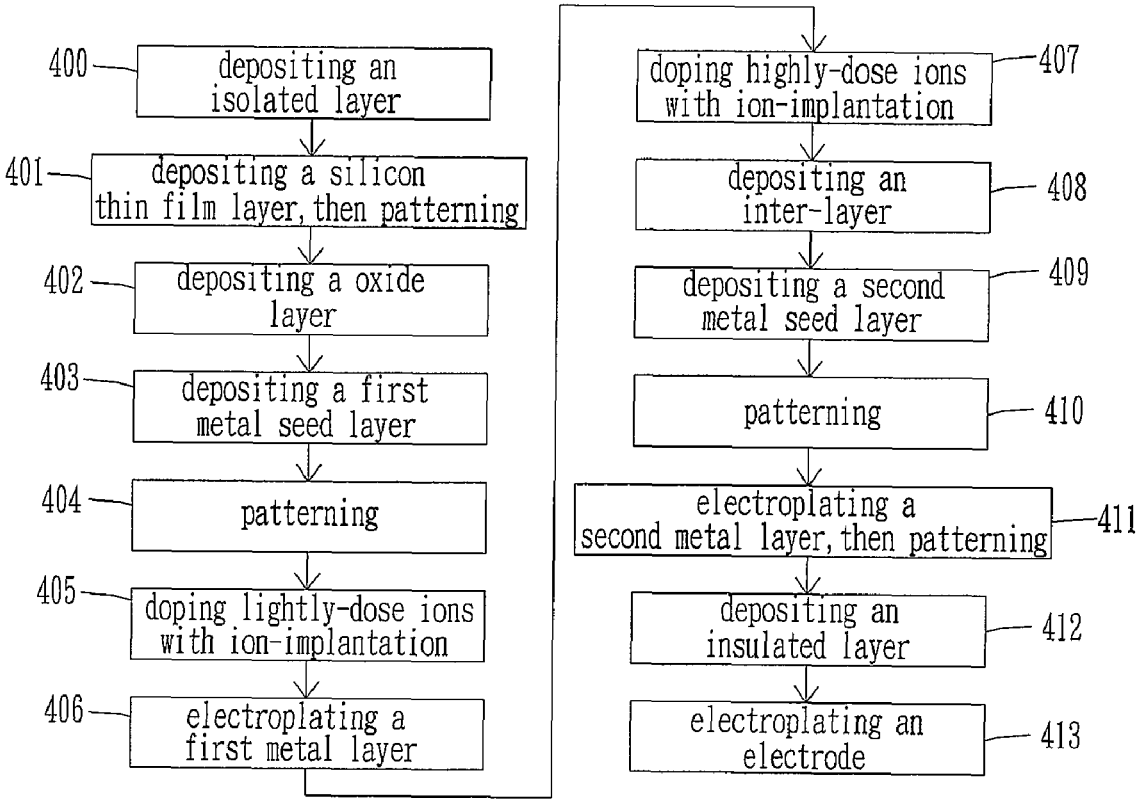
FIG. 4 is a flow chart showing the steps of process of electroplating in accordance with one preferred embodiment of present invention.

Please refer to FIG. 4, which is a flow chart showing the steps of process of electroplating in accordance with one preferred embodiment of present invention. The method for electroplating comprising steps below:

First, an oxide layer is deposited on a substrate for providing isolation (step 400). A silicon thin film layer is then deposited above the oxide layer (step 401). An oxide layer is then deposited on the silicon thin film layer (step 402). The oxide layer can be formed by thermal growth with oxygen or vapor, or by deposition process. The oxide layer is used to for isolation and mask during later process. Afterward, a first metal seed layer is deposited on oxide layer (step 403), wherein the metal seed layer is used to be a seed for attracting the metal ions in electroplating solution. A patterning is defined on the metal seed layer to determine the width of electroplated metal (step 404). A low-dose impurity is ion-implanted on the patterned metal seed layer (step 405). A first metal layer of low resistance is electroplated on the patterned metal seed layer (step 406). The first metal layer is used to reduce the resistance of metal wire on panel and is formed by immersing into a first electroplating solution, which includes the metal ions same as the first metal layer.

The silicon thin film layer is doped with high-dose trivalence or pentavalence metal impurity to form electrode on panel (step 407). An inter-layer is then deposited on resulting structure and functioned as isolation layer to prevent the shorting of each metal material (step 408). A second metal seed layer is then deposited on the inter-layer (step 409). The second metal seed layer is then patterned and etched to form data electrodes (step 410). A second metal layer is electroplated on the second metal seed layer (step 411). The second metal layer on the second metal seed layer is formed by immersing into a second electroplating solution, which includes the metal ions same as the second metal layer. An insulated layer is coated on the resulting structure to protect the whole device (step 412). Finally, an electrode is plated on the resulting structure (step 413). As recited above, the first metal layer and second metal layer covered on the first metal seed layer and second metal seed layer respectively are formed by low-resistance metal material to reduce the resistance of device.

According to the above discussion, the present invention discloses a method for electroplating metal wire improves the RC-delay of circuit on large-area substrate by low-resistance metal wiring and reduce the number of masks on processing by the structure of gate overlap and lightly-doped drain (source). Therefore, the present invention has been examined to be progressive, advantageous and applicable to the industry.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for forming metal wires and TFTs of a display, comprising the steps of:

coating an isolated layer above a substrate;

depositing a semiconductor layer above the isolated layer;

depositing an oxide layer above the semiconductor layer;

depositing and patterning a first metal seed layer on the oxide layer;

doping first impurity ions into the semiconductor layer with a first doping dose by using the first metal seed layer and the oxide layer as a mask;

electroplating a first metal layer on the first metal seed layer;

doping second impurity ions into the semiconductor layer with a second doping dose by using the first metal layer as a mask;

depositing an inter-layer;

depositing and patterning a second metal seed layer; and electroplating and patterning a second metal layer on the second metal seed layer, wherein the second doping dose is greater than the first doping dose.

2. The method as claimed in claim 1, wherein the semiconductor layer comprises Si, Ge or SiGe.

3. The method as claimed in claim 1, wherein the first and second metal layer comprises low-resistance metal materials.

4. The method as claimed in claim 1, wherein the isolated layer is used to isolate the TFTs from the substrate.

5. The method as claimed in claim 1, wherein the step of doping the first impurity ions into the semiconductor layer with the first doping dose is performed by ion-implantation or ion shower.

6. The method as claimed in claim 1, wherein the step of doping the second impurity ions into the semiconductor layer with the second doping dose is performed by ion-implantation or ion shower.

7. The method as claimed in claim 1, wherein the step of electroplating the first metal layer on the first metal seed layer is carried out by immersing the substrate into an electroplating solution, which includes the metal ions the same as the first metal layer.

8. The method as claimed in claim 1, wherein the step of electroplating the second metal layer on the second metal seed layer is carried out by immersing the substrate into an electroplating solution, which includes the metal ions the same as the second metal layer.

* * * * *